US005399824A

United States Patent [19]

Chen

[11] Patent Number: 5,399,824

[45] Date of Patent: Mar. 21, 1995

[54] COMPUTER KEY SWITCH

[76] Inventor: Pao-Chin Chen, 4F., No. 292, Sec. 2, Chien Kuo S. Road, Taipei, Taiwan, Prov. of China

[21] Appl. No.: 144,049

[22] Filed: Oct. 27, 1993

[51] Int. Cl.[6] ..... H01H 13/14

[52] U.S. Cl. ..... 200/534; 200/345

[58] Field of Search ..... 200/517, 534, 292, 345

[56] References Cited

U.S. PATENT DOCUMENTS

| | | | |
|---|---|---|---|
| 4,453,061 | 6/1984 | Tamura | 200/534 X |
| 4,467,150 | 8/1984 | Leitermann et al. | 200/292 X |
| 4,492,838 | 1/1985 | Fukukura | 200/517 |
| 4,641,004 | 2/1987 | Keprda | 200/534 |
| 5,172,990 | 12/1992 | Weng | 200/345 X |

*Primary Examiner*—Renee S. Luebke

*Attorney, Agent, or Firm*—Bucknam and Archer

[57] ABSTRACT

A computer key switch consisting of a key cap, a key body, a rubber cone, and a printed circuit board, wherein the key cap has two bottom rods movably inserted into two pin holes on the key body and two corresponding pin holes in the circuit board, two bottom hooks movably hooked in two retaining holes on the key cap and passable through two corresponding through holes in the circuit board, and a bottom plunger disposed in line with the center through hole on the key body and forced to squeeze the rubber cone; the key body has two downward hooks on two opposite sides thereof respectively hooked in two retaining holes on the printed circuit board; the rubber cone is received within the key body, having an annular top flange extended out of the center through hole on the key body and stopped against the bottom plunger of the key cap, and a conductive rubber on the inside to electrically connect a circuit on the printed circuit board upon each down stroke of the bottom plunger.

1 Claim, 2 Drawing Sheets

COMPUTER KEY SWITCH

BACKGROUND OF THE INVENTION

The keyboard in a computer system is a device for data input, which consists of a set of keys. Once a key is pressed, a specific circuit is connected to produce a specific input signal. Regular computer keyboards may be arranged into two groups, one is the mechanical type and the other is the membrane type. In a mechanical keyboard, the keys can be conveniently arranged according to the layout of the printed circuit board. As illustrated in FIG. 1, the two pins of the key switch are inserted through holes on the printed circuit board and welded in place. This mechanical key switch is expensive to manufacture and simultaneously increases the total thickness of a keyboard. Furthermore, this mechanical key switch may be damaged easily because it triggers a signal by striking.

FIG. 2 illustrates a membrane key switch according to the prior art, in which a support is formed on a frame above a membrane and a plate to support a key cap by a rubber base plate thus permitting the plunger of the key cap to be inserted through a hole in the frame. This arrangement greatly reduces the total thickness of a keyboard. However, because the post is directly formed on the frame, precision is very critical. Once the layout is fixed, the arrangement of the key switches on a keyboard can no longer be changed. Therefore, the tooling charge for a membrane keyboard is very expensive, and a high degree of risk is involved in making a mold according to the desired layout. This type of membrane keyboard is commonly used for notebook computers.

SUMMARY OF THE INVENTION

The present invention has been accomplished to provide a computer key switch which eliminates the aforesaid disadvantages. According to the preferred embodiment, a computer key switch device is comprised of a printed circuit board, a rubber cone supported on the printed circuit board, a key body mounted on the printed circuit board to hold the rubber cone, and a key cap mounted on the key body. The key cap has two bottom rods movably inserted into two pin holes on the key body, two bottom hooks movably hooked in two retaining holes on the key body, and a bottom plunger disposed in line with the center through hole on the key body and adopted to squeeze the rubber cone. The key body has two downward hooks on two opposite sides thereof respectively hooked in two retaining holes on the printed circuit board. The rubber cone is received within the key body, having an annular top flange extended into the center through hole on the key body and stopped against the bottom plunger of the key cap, and a conductive rubber on the inside to electrically connect a circuit on the printed circuit board upon each down stroke of the bottom plunger. The printed circuit board further comprises two opposite pin holes and two opposite through holes corresponding to the pin holes and retaining holes on the key cap for passing the bottom rods and bottom hooks of the key cap upon each down stroke of the bottom plunger of the key cap. Therefore, the total thickness of the key switch is greatly reduced.

DETAILED DESCRIPTION OF THE PREFERRED EMBODIMENT

Figure 1:
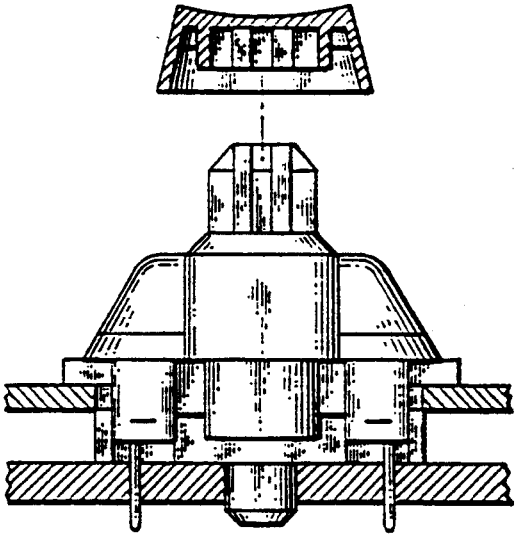
FIG. 1 (PRIOR ART)
FIG. 1 illustrates a key switch for a mechanical keyboard according to the prior art.
Figure 2:
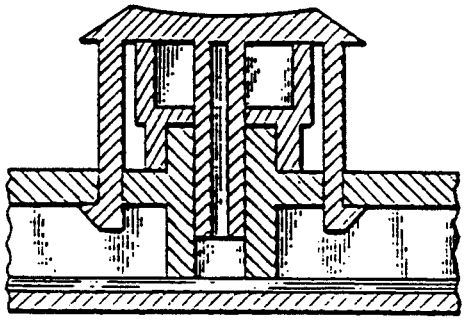
FIG. 2 (PRIOR ART)
FIG. 2 illustrates a key switch for a membrane keyboard according to the prior art.
Figure 4:
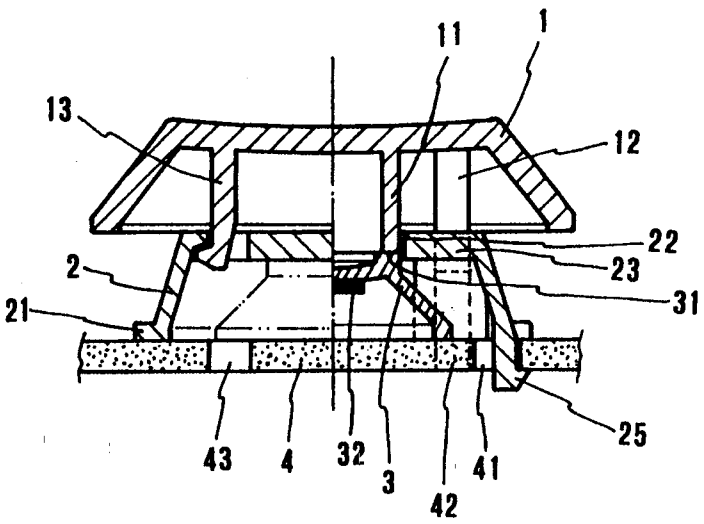
FIG. 4 is a sectional assembly view of the key switch of FIG. 3.
Figure 3:
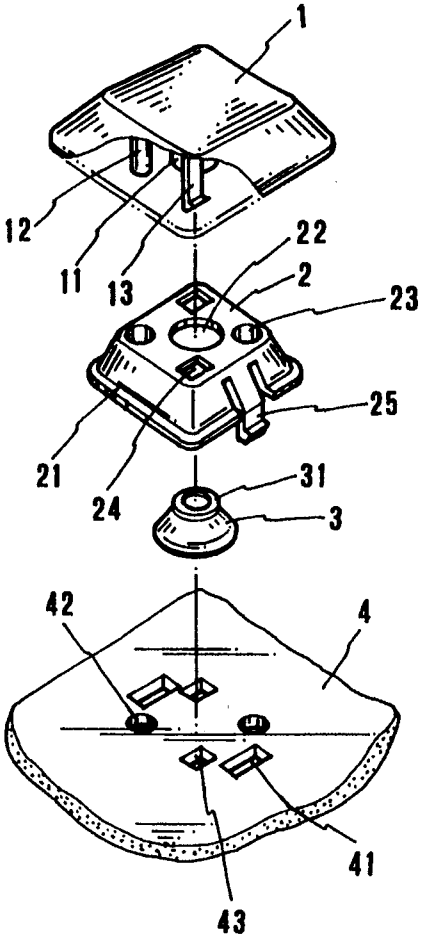
FIG. 3 is an exploded view of a key switch embodying the present invention.

Referring to FIGS. 3 and 4, a key switch as constructed in accordance with the present invention is generally comprised of a key cap 1, a key body 2, a rubber cone 3, and a printed circuit board 4. The key cap 1 is comprised of a cylindrical bottom plunger 11 in the center, two opposite bottom rods 12 and two opposite bottom hooks 13 vertically extending downwardly from the bottom thereof and alternatively spaced around the bottom plunger 11. The key body 2 is made in the shape of a hollow, truncated, square block gradually smaller toward the top, having an outward bottom flange 21 around the bottom thereof, a center through hole 22, two opposite pin holes 23 and two opposite retaining holes 24 alternatively spaced around the center through hole 22, and two opposite downward hooks 25 on two opposite sides thereof. The rubber cone 3 is made gradually reducing or tapered toward the top, having an annular top flange 31 extending into the center through hole 22 on the key body 2, and a conductive rubber 32 on the inside. The printed circuit board 4 comprises two opposite retaining holes 41, into which the two downward hooks 25 of the key body 2 hook, two opposite pin holes 42 respectively aligned with the pin holes 23 on the key body 2, and two opposite through holes 43 respectively aligned with the retaining holes 24 on the key body 2.

Referring to FIG. 4 again, when assembled, the rubber cone 3 is supported on the printed circuit board 4 and received within the key body 2 with the annular top flange 31 extending into the center-through. hole 22 on the key body 2; the key body 2 is supported on the printed circuit board 4 to hold the rubber cone 3 on the inside with the downward hooks 25 respectively hooked in the retaining holes 41 on the printed circuit board 4; the key cap 1 is mounted on the key body 2 with the bottom plunger 11 stopped against the annular top flange 31 of the rubber cone 3, the opposite bottom rods 12 are movably inserted into the pin holes 23 on the key body 2, and the opposite bottom hooks 13 are movably hooked in the retaining holes 24 on the key body 2. Therefore, pressing the key cap 1 causes the bottom plunger 11 to press against or squeeze the annular top flange 31 of the rubber cone 3. When squeezed by the bottom plunger 11, the rubber cone 3 is forced to deform permitting the conductive rubber 32 to be moved downward to electrically connect the respective switch on the printed circuit board 4, and and therefore a specific input signal is sent by the keyboard to a computer or the like. Because the printed circuit board 4 has pin holes 42 and through holes 43 for passing the bottom rods 12 and bottom hooks 13 during the down stroke of the key cap 1, the total thickness of the key switch is greatly reduced. The arrangement of the rubber cone equally distributes the pressure from the key cap 1 through all directions and prevents direct contact of the printed circuit board 4, and therefore the key cap 1 is kept on course during its movement and the printed circuit board is protected from direct impact force.

While only one embodiment of the present invention has been shown and described, it will be understood that various modifications and changes could be made without departing from the spirit and scope of the invention.

What is claimed is:

1. A computer key switch comprising:

a printed circuit board having two opposite retaining holes;

a key body mounted on said printed circuit board, said key body comprising an outward bottom flange supported on said printed circuit board, two downward hooks on two opposite sides of said key body respectively hooked in the two opposite retaining holes on said printed circuit board, a center through hole through a flat top surface of said key body disposed centrally therein, two opposite pin holes and two opposite retaining holes through the flat top surface of said key body, and alternatively spaced around said center through hole;

a rubber cone made gradually smaller toward the top and received within said key body, said rubber cone comprising an annular top flange extended into the center through hole of said key body and a conductive rubber on the inside spaced above said printed circuit board;

a key cap mounted on said key body at the top, said key cap comprising a bottom plunger stopped against the annular top flange of said rubber cone, two opposite bottom rods respectively inserted into the two opposite pin holes on said key body, and two opposite bottom hooks respectively hooked in the two opposite retaining holes on said key body; and said printed circuit board including two opposite pin holes and two opposite through holes for passing therethrough the bottom rods and bottom hooks of said key cap as said key cap is depressed;

whereby when the annular top flange of said rubber cone is squeezed by the bottom plunger of said key cap, said rubber cone is deformed, and the conductive rubber of said rubber cone is moved down to connect with a switch on said printed circuit board, and a circuit is triggered.

* * * * *